US011147318B2

(12) United States Patent
Hilton

(10) Patent No.: US 11,147,318 B2
(45) Date of Patent: Oct. 19, 2021

(54) SWADDLING GARMENT

(71) Applicant: KNITit, Grand Rapids, MI (US)

(72) Inventor: Elizabeth Ann Hilton, Holland, MI (US)

(73) Assignee: KNITit, Grand Rapids, MI (US)

( * ) Notice: Subject to any disclaimer, the term of this patent is extended or adjusted under 35 U.S.C. 154(b) by 231 days.

(21) Appl. No.: 16/292,800

(22) Filed: Mar. 5, 2019

(65) Prior Publication Data

US 2019/0274366 A1 Sep. 12, 2019

Related U.S. Application Data

(60) Provisional application No. 62/639,855, filed on Mar. 7, 2018.

(51) Int. Cl.
*A41B 13/06* (2006.01)
*A41D 10/00* (2006.01)

(52) U.S. Cl.
CPC ..... *A41B 13/06* (2013.01); *A41D 10/00* (2013.01); *A41B 2500/10* (2013.01); *A41D 2500/10* (2013.01)

(58) Field of Classification Search
CPC ... A41B 13/06; A41B 13/065; A41B 2500/10; A47G 9/08; A41D 10/00; A41D 10/25; A41D 10/10
USPC ..... 2/69, 69.5, 83, 111; 5/494, 655
See application file for complete search history.

(56) References Cited

U.S. PATENT DOCUMENTS

| | | | | |
|---|---|---|---|---|
| 6,393,612 | B1 * | 5/2002 | Thach | A41B 13/065 2/69.5 |
| 6,868,566 | B2 * | 3/2005 | Gatten | A41B 13/06 2/69 |
| 7,587,769 | B1 * | 9/2009 | McDermott | A41B 13/06 2/69 |
| 8,191,189 | B1 * | 6/2012 | Spell | A47G 9/083 5/494 |
| 8,863,329 | B2 * | 10/2014 | Gangan | A41B 13/06 5/494 |
| 2012/0110716 | A1 * | 5/2012 | Christensen | A47G 9/083 2/69.5 |
| 2013/0160181 | A1 * | 6/2013 | Mohr | A41B 13/06 2/69 |
| 2013/0283527 | A1 | 10/2013 | Houston et al. | |
| 2018/0020750 | A1 * | 1/2018 | Nam | A41D 15/04 2/69 |
| 2018/0103689 | A1 * | 4/2018 | DeLisa | A41B 13/06 |
| 2019/0254355 | A1 * | 8/2019 | Griffin | A41D 27/20 |

* cited by examiner

*Primary Examiner* — Katherine M Moran
(74) *Attorney, Agent, or Firm* — Warner Norcross + Judd LLP

(57) ABSTRACT

A swaddling garment, such as for swaddling a baby or use as a compression garment, includes a tubular body having a circular neck opening, arm sleeves formed within the tubular body defining arm-receiving spaces, and a torso-receiving space within the tubular body between the arm sleeves. The swaddling garment is a one-piece, seamless, or/or knit swaddle, without closures, configured to snugly receive a wearer's torso and arms.

14 Claims, 5 Drawing Sheets

SWADDLING GARMENT

CROSS-REFERENCE TO RELATED APPLICATION(S)

The present application claims the benefit of U.S. Provisional Patent Application No. 62/639,855, filed Mar. 7, 2018, which is incorporated herein by reference in its entirety.

BACKGROUND

The present invention relates to swaddling garments or swaddles, including infant swaddles and other compression garments.

Swaddling is the practice of snugly wrapping an infant in a thin blanket or sheet, to help them feel safe and secure. Infants typically do not sleep through the night, and swaddling can help them sleep longer. Feeling held and snug can help to calm and soothe an infant, and reduce excessive crying. Swaddling can also be part of deep pressure therapy that provides firm tactile sensory input to the wearer and provides proprioceptive input to the whole body.

Being swaddled can stop an infant from being disturbed by their own Moro reflex, an infantile reflex normally present in all infants up to 3 or 4 months of age as a response to a sudden loss of support, when the infant feels as if it is falling and causes their arms to spread, which can in turn wake the infant from sleep. With their arms loose, infants can also scratch their face throughout the night.

Blanket or sheet swaddles can easily come loose with improper wrapping technique, and infants can even learn to escape a swaddle, either of which eliminates any value swaddling may provide. A loose swaddle also potentially poses a suffocation hazard. However, swaddling too tightly can affect mobility and development. Some ready-made swaddles include hook and loop type fasteners or zipper closures. Often, these can be difficult to use properly and easy for an infant to escape. Since infants are not yet capable of regulating their own body temperature, infants can also become overheated in a swaddle without careful monitoring.

BRIEF SUMMARY

The present invention provides swaddling garment, such as an infant swaddle or compression garment. In one embodiment, the swaddling garment includes a tubular body defining an interior volume and having a circular neck opening into the interior volume the tubular body, a first arm sleeve formed within the tubular body, the first arm sleeve having a first arm entry opening and defining a first arm-receiving space, a second arm sleeve formed within the tubular body, the second arm sleeve having a second arm entry opening and defining a second arm-receiving space, and a torso-receiving space within the tubular body between the first and second arm sleeves.

In some embodiments, the swaddling garment is a one-piece, seamless, or/or knit swaddle configured to snugly receive a wearer's torso and arms. Zero closures are required to secure the swaddling garment.

In certain embodiments, the swaddling garment 10 can be made from a stretchable knit textile material using a 3D additive manufacturing process or 3D knitting.

The present invention provides an effective swaddling garment that receive a wearer's torso and arms and applies light compression so the wearer feels he/she is receiving a hug. The swaddling garment is engineered with arm sleeve or tubes to keep the wearer's arms down, and can counteract the Moro reflex.

These and other objects, advantages, and features of the invention will be more fully understood and appreciated by reference to the description of the current embodiments and the drawings.

Before the embodiments of the invention are explained in detail, it is to be understood that the invention is not limited to the details of operation or to the details of construction and the arrangement of the components set forth in the following description or illustrated in the drawings. The invention may be implemented in various other embodiments and of being practiced or being carried out in alternative ways not expressly disclosed herein. In addition, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components.

DESCRIPTION OF THE CURRENT EMBODIMENT(S)

Figure 2:
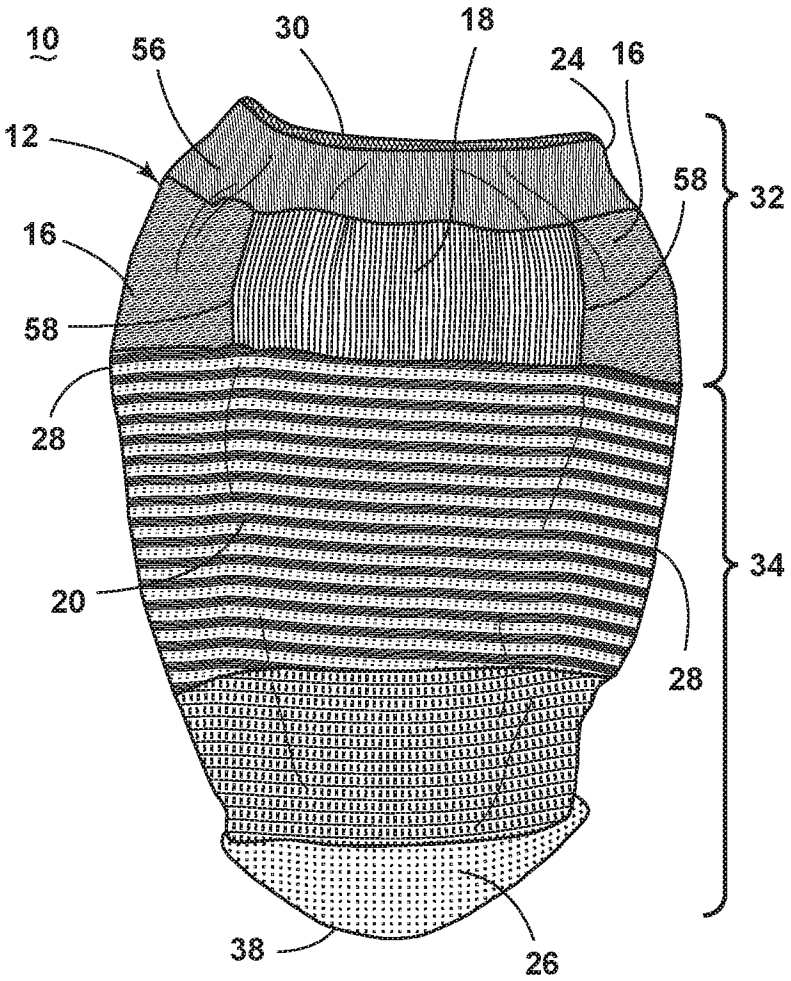
FIG. 2 is a rear view of the swaddling garment of FIG. 1.

A swaddling garment according to one embodiment of the present invention is shown in FIGS. 1-4 and generally designated 10. The swaddling garment 10 can be an infant swaddle that provides light compression to the infant wearer. In the illustrated embodiment, the swaddling garment 10 can include a tubular body 12 defining an interior volume 14, arm sleeves 16 formed within the tubular body 12 for receiving the arms of the wearer, and a torso-receiving space 18 within the tubular body 12 between the arm sleeves 16 for receiving the torso of the wearer, as described in further detail below.

The swaddling garment 10 in the current embodiment is a one-piece, seamless knit swaddle configured to snugly receive a wearer's torso and arms to help them feel safe and secure, and to keep the wearer's arms down throughout the night. In being seamless, the swaddling garment 10 has no seams, and does not include any lines formed by sewing pieces of textile material together. Rather, the swaddling garment 10 is smoothly continuous, e.g. by being a continuously-knit garment. Zero closures are required to secure the swaddling garment 10, making the swaddling garment 10 easier to use and more convenient for a caregiver and more escape-proof. The swaddling garment 10 can be made from a stretchable knit material using a 3D additive manufacturing process, providing the ability to easily create the garment without closures, and optionally from multiple different yarns simultaneously. The swaddling garment 10 is engineered with arm sleeve or tubes 16 to keep the infant's arms down and fight against the Moro reflex, and provides light compression so the infant feels he/she is receiving a hug, thereby encouraging maximum sleep. In one example, the swaddling garment 10 can be configured to apply a compression of ≤10 mmHg to the infant.

The swaddling garment 10 is constructed from a textile material. A textile material is an article manufactured from strands, such as threads cables, yarn, fibers, filaments, cords and other strand like elongated structures. Strands can be characterized by their fineness, flexibility and a generally high ratio of length to thickness. Some conventional strands have an indefinite length and can be combined with other strands to produce a yarn for use in the textile material. Some strands include synthetic and/or polymeric materials such as nylon, rayon, polyester and/or polyacrylic compounds. Other strands include wool, cotton, bamboo and/or other or natural materials. Textile materials can be produced directly from certain strands by randomly interlocking the same to construct non-woven fabrics and felts. Alternatively, textile materials can be produced through machine implemented mechanical manipulation of strands, thereby producing knitted material. In one example, the swaddling garment 10 can be made from any textile material suitable for use in swaddling an infant while providing warmth to the infant.

The textile material from which the swaddling garment 10 is constructed can be produced by manipulating strands, using various techniques implemented on a machine, rather than performed manually, by a human. One technique is knitting, which includes interlooping strands in a series of connected loops, optionally forming multiple rows of intermeshing loops. The knitting process can be any of a variety of different knitting processes, for example circular knitting, tubular knitting, flat knitting, sweater knitting, Jacquard knitting, Intarsia knitting, weft knitting, warp knitting and other types of knitting. Other techniques for producing the textile material for the swaddling garment 10 include weaving, crocheting, knotting, felting, or braiding.

In one specific embodiment, the swaddling garment 10 is constructed using 3D additive manufacturing or 3D knitting. This technology allows for the swaddling garment 10 to have inherent zones of different qualities, stretch characteristics, and behaviors in isolated areas without needing any post knit process. Using 3D knitting, the swaddling garment 10 can be constructed from light compression yarns and without seams to simulate a hug while also knitting a different construction that allows the infant's arms to comfortably slip in and stay down. In one example, the 3D knit swaddling garment 10 can be configured to apply a compression of ≤10 mmHg to the infant.

The textile material used for the swaddling garment 10 is preferably a high-stretch material, such as a knit jersey. In one specific embodiment, the swaddling garment 10 is knit with a nylon core spun around a spandex core. Other suitable yarns include nylon or bamboo. Alternatively, the swaddling garment 10 can be knit with any yarn or strand that has some stretch. This includes moisture wicking yarns, anti-microbial yarns, and yarn technology with thermal body temperature management, including yarn that can help to keep the baby's body temperature at 37.5° C. In other embodiments, low-stretch materials such as cotton and fleece can be used. A knit cotton or polyester fleece are examples of suitable low-stretch materials.

In one embodiment, at least the torso-receiving space 18 the swaddling garment 10 is constructed from a high-stretch material having a stretch and recovery of 100% in width and 50% in length. Other regions of the swaddling garment can have a similar stretch/recovery, can be configured to stretch more, or can be configured to stretch less.

While being constructed from a unitary textile material, the different regions of the swaddling garment 10 can have different physical and/or mechanical properties, for example, different elasticity, different stretch, different three-dimensional or two-dimensional shape(s), different air permeability or flow, different compression, different weight, different texture, and/or different heat retention. Further, the strands in the different regions can be constructed from different material to import the different physical and/or mechanical properties. In other embodiments, the different regions of the swaddling garment 10 can have the same physical and/or mechanical properties, and/or use only one strand type or yarn type per region.

The creation of the different regions can be accomplished in a number of manners. In one, different strand manipulation techniques, for example, different knitting stitches can be used to achieve variation in properties. For example, different knitting stitches can be used to achieve variation in compression, air permeability, stretch, and recovery. A low-stretch or high compression region can be formed using a tighter stitch. Where low heat retention is desired, such as to prevent an infant from becoming overheated, a high airflow region can be produced by using a looser or more open stitch. The stitch constructions for different regions of the swaddling garment 10 can be manipulated by changing single jersey areas to double jersey or rib areas, half gauging the design, using inlay, changing around tuck, misses, and knit stitches. Different strands (i.e. type, texture, and twist) and different needle sizes can also be used to achieve variation in properties.

Figure 1:
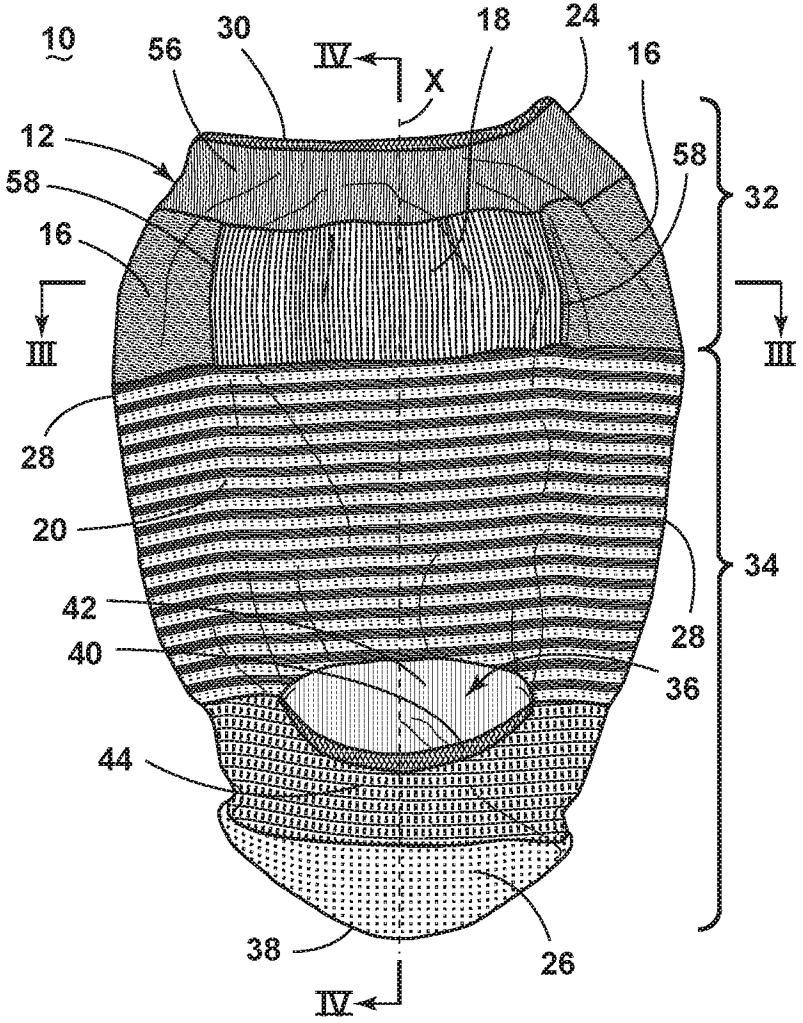
FIG. 1 is a front view of a swaddling garment according to a first embodiment of the invention.
Figure 3:
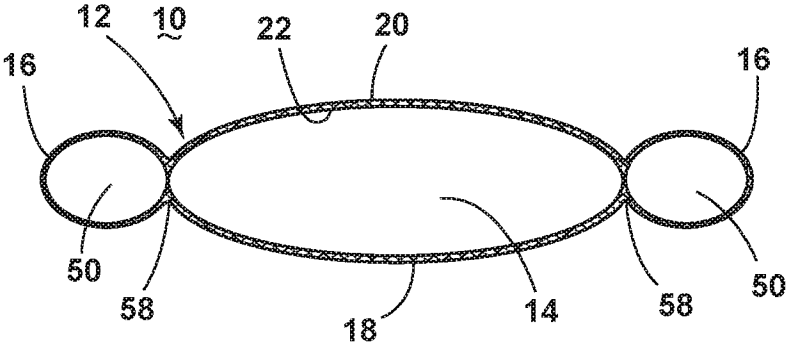
FIG. 3 is a cross-sectional view of the swaddling garment of FIG. 1 taken through line III-III of FIG. 1.

With reference to FIGS. 1-3, the tubular body 12 can include an outer surface 20 and an inner surface 22 opposite the outer surface 20 and defining the interior volume, generally designated by 14, sized and shaped for receiving at least the arms and torso of an infant or other wearer. In the illustrated embodiment, the interior volume 14 is further configured to receive the legs of an infant or other wearer. The tubular body 12 includes a first or head end 24 and a second or foot end 26 opposite the head end 24.

The arm sleeves 16 can be provided adjacent lateral sides 28 of the tubular body 12, with a portion of the arm sleeves 16 optionally defining a portion of the lateral sides 28 of the body 12. The tubular body 12 can be symmetrical about a longitudinal axis X as shown in FIG. 1, with the longitudinal axis X defining a midline of the tubular body 12, and the arm sleeves 12 disposed laterally with respect to the midline to define at least a portion of the lateral sides 28 of the tubular body 12.

When viewed from the front and substantially lying flat as shown in FIG. 1, the tubular body 12 can be straight between the head end 24 and foot end 26, can taper toward one or both of the ends 24, 26, or can widen toward one or both of the ends 24, 26. In other words, the lateral sides 28 can be equidistant between the head end 24 and foot end 26, can converge toward one or both of the ends 24, 26, or can diverge toward one or both of the ends 24, 26. Still other shapes for the tubular body 12 are possible. In the embodiment shown in FIG. 1, the tubular body 12 is widest at the lower end of the arm sleeves 16, tapers toward the head end 24 and tapers more significantly toward the foot end 26.

The tubular body 12 can have a neck opening 30 for accessing the interior volume 14 the tubular body 12. The neck opening 30 provides an access opening through which an infant or wearer can be inserted into and removed from the interior volume 14 of the body 12. When the swaddling garment 10 is worn by an infant, the head, neck, and optionally the shoulders, of the infant project from the neck opening 30. Optionally, as shown in FIGS. 1-2, the neck opening 30 can be shaped with a slightly curved profile to come up higher at the lateral sides 28 of the tubular body 12 to cover the shoulders of the infant.

In some embodiments, the swaddling garment 10 can include no other openings other than the neck opening 30 for providing access to the interior volume 14 of the body 12. In other embodiments, the swaddling garment 10 can include at least one other opening for accessing the legs and lower torso for diaper changing, as described in further detail below.

The neck opening 30 can be circular, and can be a continuous, uninterrupted edge at the head end 24 of the garment 10. The neck opening 30 can stretchable to enable the neck opening 30 to be passed over the infant's body. In embodiments where the swaddling garment 10 is a knit garment, the neck opening 30 is formed by a bind-off to define a finished final edge of the knitted garment 10, and requires no further sewing or finishing on this edge.

The arm sleeves 16 and torso-receiving space 18 can form an upper portion 32 of the tubular body 12 that, when worn, is substantially aligned with infant's arms and upper torso. A lower portion 34 of the tubular body 12 can extend from the upper portion 32 to define the foot end 26. The lower portion 34 can be substantially aligned with infant's lower torso, hips, legs, and/or feet, and can define a lower-body receiving space. The lower portion 34 is sized and shaped to fit more loosely than the upper portion 32 to provide the legs of the infant or wearer with sufficient space to permit the infant to flex and abduct its hips within the interior volume 14 of the tubular body 12. For example, the diameter of the tubular body 12 at the lower portion 34 can be greater than the diameter of the torso-receiving space 18. Because the infant's hips and legs are not restricted by the lower portion 34 of the garment 10, improper muscle development in the lower body and hip dysplasia do not result from using the garment 10. As an added benefit, having the lower portion 34 loosely fitted with the infant allows easier access for diaper changing, as described in further detail below.

The foot end 24 or lower portion 34 of the body 12 can be closed, open, or, as shown in the illustrated embodiment, comprise an envelope fold 36 for accessing the legs and lower torso of the infant. An open or envelope foot end 24 allows the infant to be accessed from the bottom end of the garment 10, which is convenient for diaper changes. In particular, the open or envelope foot end 24 permits the infant's diaper to be changed without completely removing the garment 10, or even uncovering the torso and arms of the infant.

In the illustrated embodiment, the foot end 24 with the envelope fold 36 includes a closed bottom 38 with an access opening 40, which can be spaced above the closed bottom 38. The envelope fold 36 can be formed by overlapping inner and outer flaps 42, 44 to create a pouch in which the infant's lower legs and/or feet are received. The outer flap 44 extends over at least a portion of the inner flap 42 to cover the access opening 40 so that the infant's feet will remain securely swaddled and warm within the garment 10. The outer flap 44 can easily be pulled down and around the infant's feet, allowing the infant's feet pass through the access opening 40 and the lower end of the swaddling garment 10 to be bunched up for a diaper change.

Figure 4:
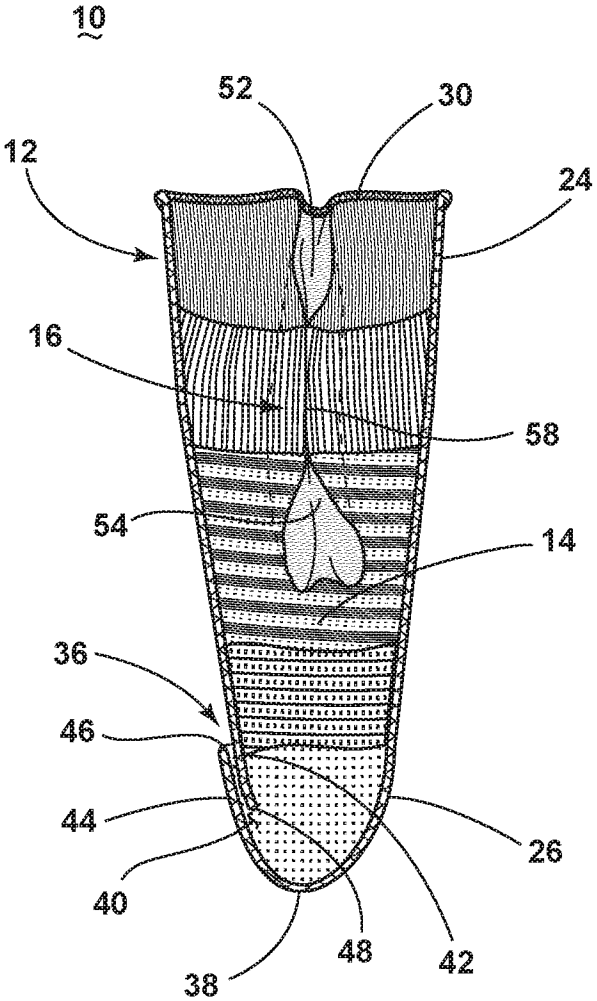
FIG. 4 is a cross-sectional view of the swaddling garment of FIG. 1 taken through line IV-IV of FIG. 1.

Referring to FIG. 4, the outer flap 44 has an upper edge 46 and the inner flap 42 has a lower edge 48, the upper edge 46 being spaced about the lower edge 48 when the access opening 40 is covered as shown in FIG. 4. The flaps 42, 44 and their edges 46, 48 can stretchable to enable lower end of the swaddling garment 10 to be passed over the infant's body. In embodiments where the swaddling garment 10 is a knit garment, one or both of the edges 46, 48 can be formed by a bind-off to define a finished final edge of the knitted garment 10, and requires no further sewing or finishing on the edge.

In some embodiments, the flaps 42, 44 can be the sole area of overlapping layers of textile material or fabric on the swaddling garment 10. Otherwise, the swaddling garment 10 can be made from one layer of textile material or fabric. In other embodiments, the entire swaddling garment 10 may be made from one layer, such that the infant or wearer has only one layer of textile material or fabric on a given area of their body. With such an embodiment, the foot end 24 or lower portion 34 of the body 12 may be closed or open, rather than comprising an envelope fold.

Referring to FIGS. 3-4, the arm sleeves 16 define arm-receiving spaces 50 within the interior volume 14 of the tubular body 12 in which the infant's arms can be received and snugly held. The arm-receiving spaces 50 are internal to the tubular body 12. The arm sleeves 16 include an upper open end 52 or arm entry opening, which provides an access opening through which an arm can be inserted into and removed from the arm-receiving space 50. In at least some embodiments, the upper open end 52 can fit in the infant's armpit, and can prevent the swaddling garment 10 from riding up.

The arm sleeves 16 further include a lower end 54 opposite the upper open end 52, and can be closed to receive the hands of the infant or wearer within the arm sleeve 16, or can be open as shown in the illustrated embodiment. The open lower ends 54 shown can define hand openings through which the hands of the arm can protrude from the sleeves 16.

The upper open ends 52 or arm entry openings can be spaced from the neck opening 30, so that a portion of the garment 10 extends upwardly over the shoulders of the infant or wearer. A shoulder band 56 can extend around the circumference of the tubular body 12 and can include the neck opening 30 at a top edge thereof. The shoulder band 56 can be formed at the upper edge of the arm sleeves 16 and torso-receiving space 18. Optionally, as shown in FIGS. 1-2, the shoulder band 56 can taper inwardly toward the neck opening 30 to keep textile material away from the infant's face.

As best seen in FIG. 3, in the area of the arm sleeves 16 and torso-receiving space 18, the tubular body 12 includes three continuously formed tubes, with each tubes formed by a single layer of textile material without overlap. In the area above and below the arm sleeves 16 and torso-receiving space 18, the tubular body 12, the tubular body 12 can include a single tube formed by a single layer of material without overlap. At the envelope fold 36, the tubular body 12 can include overlapping layers of textile material in the form of the flaps 42, 44.

The arm sleeves 16 and torso-receiving space 18 transition smoothly to one another at an intersecting portion 58. In the transition, there is no seam or other separately constructed fastener connecting the different regions at the intersecting portion 58. Instead, the different regions of the one-piece swaddling garment 10 simply transition to one another by modifying the knitting and/or weaving pattern or structure from one region to the next, without adding a separately constructed attachment element to the unitary textile material. Other similar transitions can be included between other regions of the swaddling garment 10.

In one example, an interlock stitch can be used at the transition to form the intersecting portion 58 and to isolate the torso-receiving space 18 from the arm sleeves 16. The arm sleeves 16 can be formed within the tubular body 12 by an interlock stitch or other suitable knitting stitch connecting a front side of the tubular body 12 to a rear side of the tubular body 12. The front and rear sides of the tubular body 12 can be otherwise unconnected. The arm sleeves 16 can be formed within the tubular body 12 by other means of connection between the front and rear sides of the tubular body 12, such as by sewing, adhering, gluing or otherwise fastening the front and rear sides to one another.

As mentioned above, the arm sleeves 16 and torso-receiving space 18 can have a different set of properties. The different regions also can have varied geometric properties, for example, shape, dimension and thickness. The different properties can enable the different regions of the one-piece swaddling garment 10 to have functional variability. As an example of differences between the regions, the arm sleeves 16 and torso-receiving space 18 can include knit stitches that impart a different compression; for example, the torso-receiving space 18 can provide more compression than the arm sleeves 16. In one example, the torso-receiving space 18 can be configured to apply a compression of ≤10 mmHg to the torso of the infant, and the arm sleeves 16 can be configured to apply a compression of ≤8 mmHg to the arms of the infant.

It is noted that the patterns depicted in the different regions of the swaddling garment 10 shown in FIGS. 1-4 are but one example, and that in other embodiments of the swaddling garment 10, the different regions can be constructed with other patterns, strand or yarn types, strand or yarn combinations, and/or knitting stitches.

Figure 5:
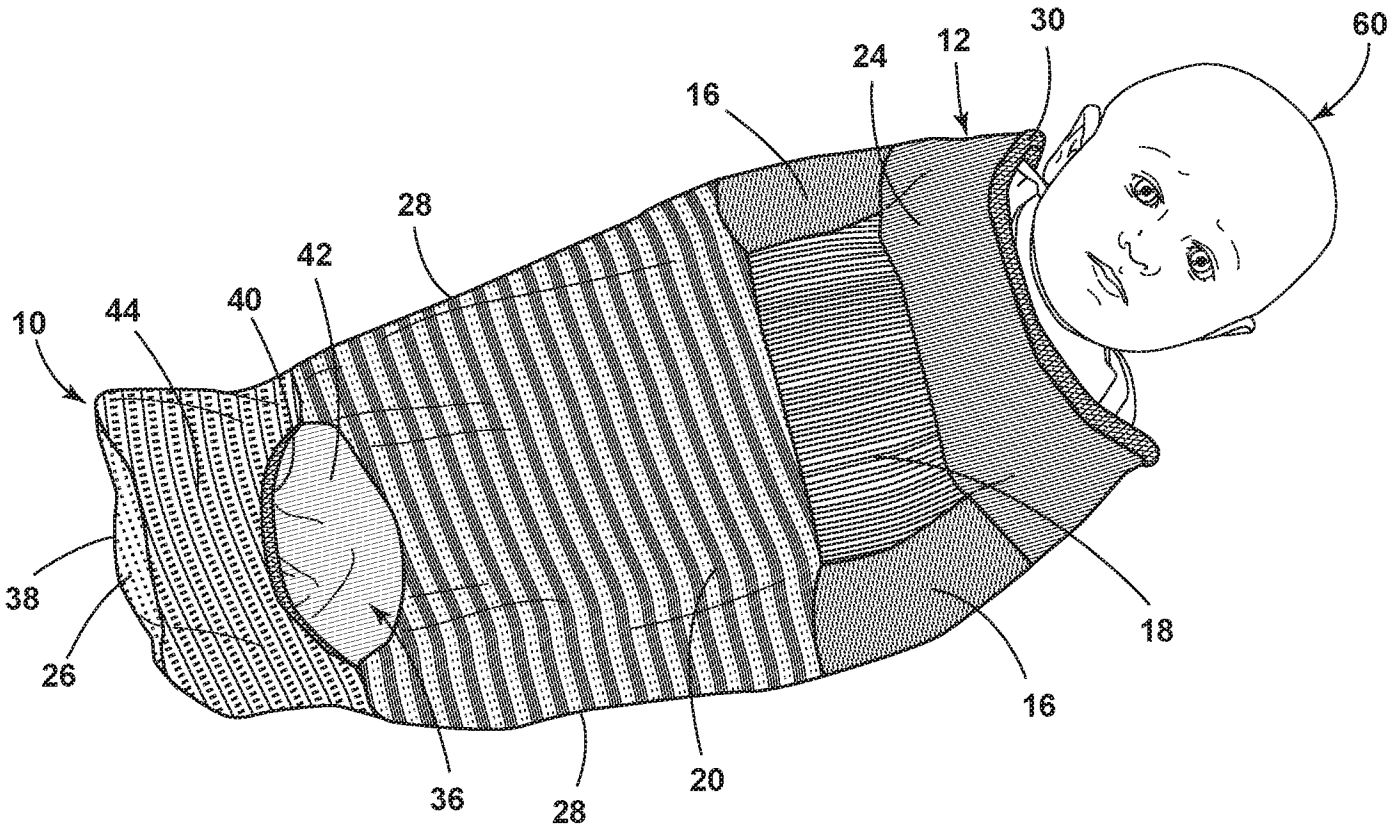
FIG. 5 is a representative view of an infant wearing the swaddling garment of FIG. 1.

FIG. 5 depicts an example of an infant 60 swaddled in the swaddling garment 10. The swaddling garment 10 covers the torso, arms, and legs of the infant 60, with the infant's head, neck, and upper shoulders exposed. The swaddling garment 10 also functions as a blanket to keep the baby infant 60 warm, and the substantially single layer, knitted construction prevents the infant 60 from becoming overheated. The seamless, sack-like design involving no closures allows a caregiver to easily slide the infant 60 into and out of the swaddling garment 10.

To insert the infant 60 into the swaddle, the center torso-receiving space 18 is stretched around the infant's legs and pulled up around his or her torso. Next, the infant's arms are slid into the arm sleeves 16. If necessary, the shoulder band 56 is comfortable settled around the shoulders of the infant 60 with the neck opening 30 resting at his or her shoulders or neck. Zero closures are required to secure the swaddling garment 10.

A method for manufacturing the swaddling garment 10 will now be described. Generally, the one-piece swaddling garment 10 can be constructed from multiple strands. These strands can be manipulated to form the textile, for example, by knitting (which can encompass intertwining and/or twisting) the strands.

As the swaddling garment 10 the is constructed, the arm sleeves 16, torso-receiving space 18 and any other regions, having different sets of properties as described above, are formed integrally within the unitary textile material. In most cases, the arm sleeves 16 and torso-receiving space 18 are not sewn, adhered, glued or otherwise fastened to one another. Instead, the structure of the unitary textile material joins the different regions at some intersecting portion as described above, including intersecting portion 58, so that the different regions are contiguous and uninterrupted.

Optionally, the arm sleeves 16 can be less densely knitted and more stretchable or elastic than the torso-receiving space 18. Other regions of the swaddling garment 10 can likewise be less densely knitted and more stretchable or elastic than the torso-receiving space 18, with different physical and/or mechanical properties and associated performance characteristics and/or attributes associated with different regions or sections of the swaddling garment 10.

The swaddling garment 10 can be constructed from a plurality of strands that can be knitted or woven in a network with one another, or alternatively non-woven. The strands can be in the form of threads, cables, yarn, fibers, filaments, cords and other strand-like elongated structures. The strands can be constructed from a material, such as a thermoplastic polymer material or other polymeric or natural materials. As an example, thermoplastic polymer strands can be constructed from a variety of materials such as nylon, polyurethane, polyester, polyester polyurethane, polyether polyurethane, other polymeric materials, and combinations thereof.

Optionally, multiple different types of strands can be knitted with one another integrally to form the swaddling garment 10. For example, the swaddling garment 10 can be constructed using a first strand and a second strand. The first strand can be constructed to have a first mechanical or physical property, such as a first elasticity. The second strand can be constructed to have a second mechanical or physical property. For example, the second strand can have a second elasticity than is greater that the first elasticity.

The swaddling garment 10 can be constructed on a knitting machine. In one embodiment, the swaddling garment 10 can more particularly be constructed using flatbed weft knit technology, with the pattern for the swaddling garment 10 programmed on 3D knitting software and then constructed in a one-step process using a flatbed weft knitting machine.

The swaddling garment 10 can be knitted using a single knit stitch type. Alternatively, multiple different knit stitch types can be utilized so that different regions of the garment 10 exhibit different physical and/or structural properties, for example, different compression, air permeability, stretch, recovery, etc. The stitch constructions can be manipulated by changing single jersey areas to double jersey or rib areas, half gauging the design, using inlay, changing around tuck, misses, and knit stitches.

While the swaddling garment 10 may be knit, in an alternate embodiment, the swaddling garment 10 can be comprised of multiple patchwork pieces that are sewn, stitched, glued, adhered, fused, melted, and/or thermally bonded. In yet another embodiment, the swaddling garment 10 can be comprised of a weave or a mesh.

Figure 6:
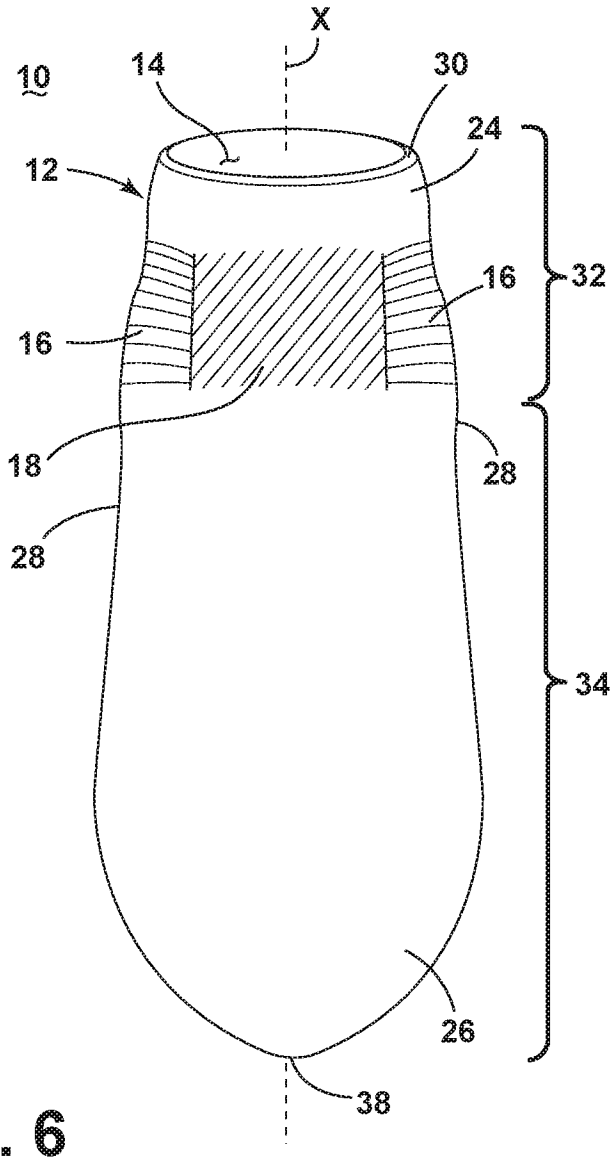
FIG. 6 is a front view of a swaddling garment according to a second embodiment of the invention.

A swaddling garment 10 according to a second embodiment of the invention is shown in FIG. 6. The swaddling garment 10 can be substantially similar to the swaddling garment 10 of the first embodiment, and like elements are referred to by the same reference numerals. The swaddling garment 10 of FIG. 6 differs from the first embodiment by having a closed foot end 24 or lower portion 34 of the body 12. The closed bottom 38 includes no access opening, and the neck opening 30 provides the sole access opening through which an infant or wearer can be inserted into and removed from the interior volume 14 of the body 12. The swaddling garment 10 can be made from one layer of textile material or fabric, and is substantially sack-shaped.

Figure 7:
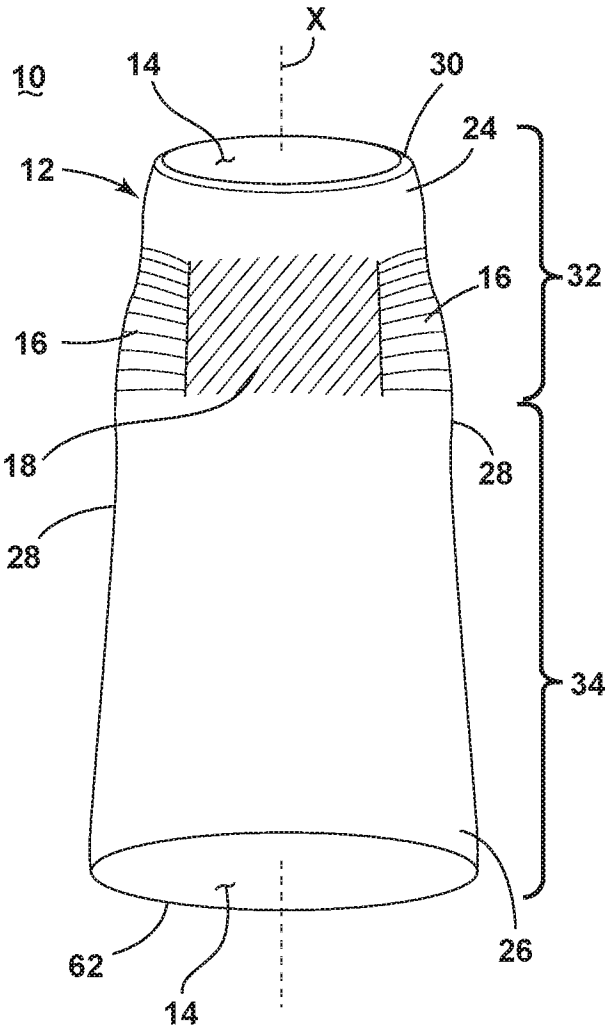
FIG. 7 is a front view of a swaddling garment according to a third embodiment of the invention.

A swaddling garment 10 according to a third embodiment of the invention is shown in FIG. 7. The swaddling garment 10 can be substantially similar to the swaddling garment 10 of the first embodiment, and like elements are referred to by the same reference numerals. The swaddling garment 10 of FIG. 7 differs from the first embodiment by having an open foot end 24 or lower portion 34 of the body 12, with the foot end 24 including a bottom opening 62. The bottom opening 62 defines an access opening through which the infant's lower legs and lower torso can be accessed for convenient diaper changes. In particular, the bottom opening 62 permits the infant's diaper to be changed without completely removing the garment 10, or even uncovering the torso and arms of the infant. The swaddling garment 10 can be made from one layer of textile material or fabric, and is substantially tube-shaped.

The bottom opening 62 can be circular, and can be a continuous, uninterrupted edge at the foot end 26 of the garment 10. The bottom opening 62 can stretchable to enable the bottom opening 62 to be passed over the infant's legs and lower torso. In embodiments where the swaddling garment 10 is a knit garment, the bottom opening 62 can be formed by a bind-off to define a finished final edge of the knitted garment 10, and requires no further sewing or finishing on this edge.

Figure 8:
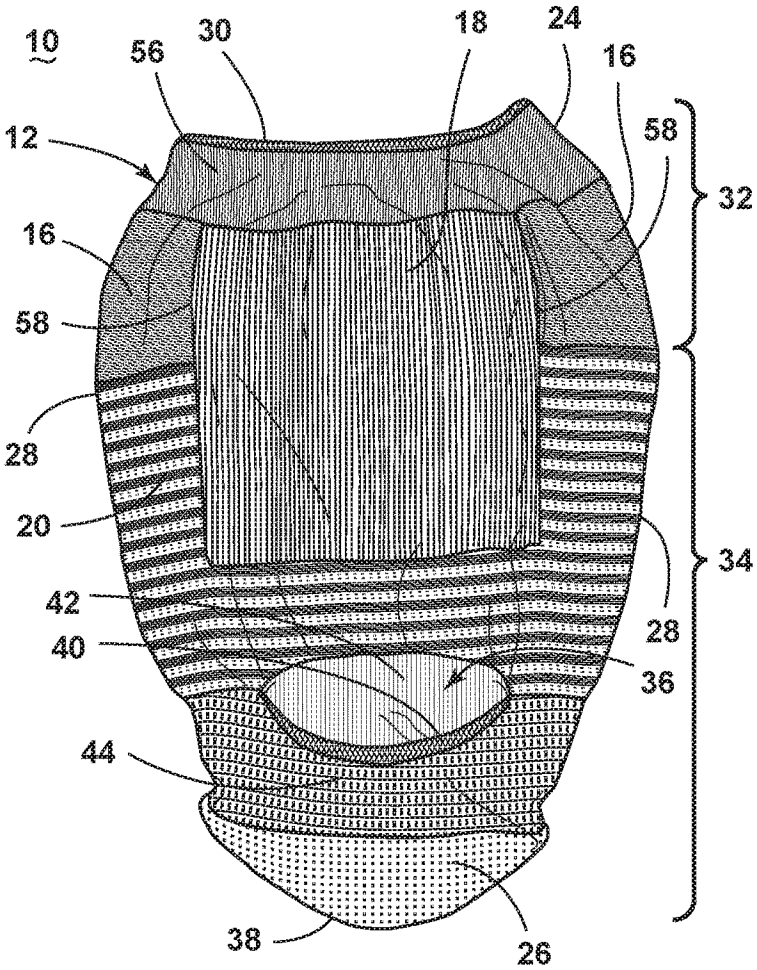
FIG. 8 is a front view of a swaddling garment according to a fourth embodiment of the invention.

A swaddling garment 10 according to a fourth embodiment of the invention is shown in FIG. 8. The swaddling garment 10 can be substantially similar to the swaddling garment 10 of the first embodiment, and like elements are referred to by the same reference numerals. The swaddling garment 10 of FIG. 8 differs from the first embodiment by having the torso-receiving space 18 extend farther down the torso of the infant such that, when the swaddling garment 10 is worn, the torso-receiving space 18 is substantially aligned with infant's entire torso, i.e. the upper torso and the lower torso, including the abdomen. The torso-receiving space 18 provides compression to substantially the infant's entire torso, including the abdomen, which can be beneficial to colicky babies as gentle pressure on the abdomen can ease the symptoms of colic. The swaddling garment 10 of FIG. 8 can therefore be used to treat colic in infants.

In the embodiment shown, the torso-receiving space 18 extends past the arm sleeve 16, rather than being substantially coextensive with the arm sleeves 16 as shown in FIG. 1. The torso receiving space 18 can therefore form portions of both the upper and lower portions 32, 34 of the garment 10. As noted above, the torso-receiving space 18 provides compression to substantially the infant's entire torso, including the abdomen. The remaining portion of the lower portion 34 is sized and shaped to fit more loosely to provide the legs of the infant or wearer with sufficient space to permit the infant to flex and abduct its hips. In one example, the torso-receiving space 18 can be configured to apply a compression of ≤10 mmHg to the infant's abdomen.

There are several advantages of the present disclosure arising from the various features of the methods, systems, and apparatus described herein. For example, the embodiments of the invention described above an infant swaddle that is a one-piece garment without closures. A caregiver only has to slide the swaddle up and around the infant's body, and tuck their arms into the arm tubes, the swaddle 10 makes it particularly easy to swaddle a baby, despite any wiggling or squirming from the baby. No cumbersome wrapping or closure fastening are required. With no wrapped layers or closures, there is no chance of the swaddle becoming loose enough for the baby to escape. Yet another advantage is that the single layer design can prevent an infant from becoming overheated, and the optional use of thermal yarn can further help to regulate body temperature.

While the swaddling garment 10 of FIGS. 1-8 is shown and discussed for wear by an infant, any embodiment of the swaddling garment 10 disclosed herein can alternatively be sized for wear by a toddler, child, teen, or adult. The swaddling garment 10 can be provided in varying sizes depending on the age of the wearer, and can be sized for newborns, babies, toddlers, children, teens, or adults. Generally speaking, the size range of infant swaddles can range from 0 to 24 months, and more particularly from 0 to 12 months. The stretchy material also stretches to accommodate a range of sizes, including a range of weights and lengths, and accommodates for the growth of an infant without having to purchase more than one size.

As another alternative, any embodiment of the swaddling garment 10 disclosed herein can be a deep pressure therapy garment that provides firm tactile sensory input to the wearer and provides proprioceptive input to the whole body. The compression provided by the deep pressure therapy garment simulates a hug, can produce a calming and/or, organizing effect on the wearer, and relaxes the nervous system. In one example, the swaddling garment 10 can be configured to apply 10-40 mmHg of compression to the wearer.

Figure 9:
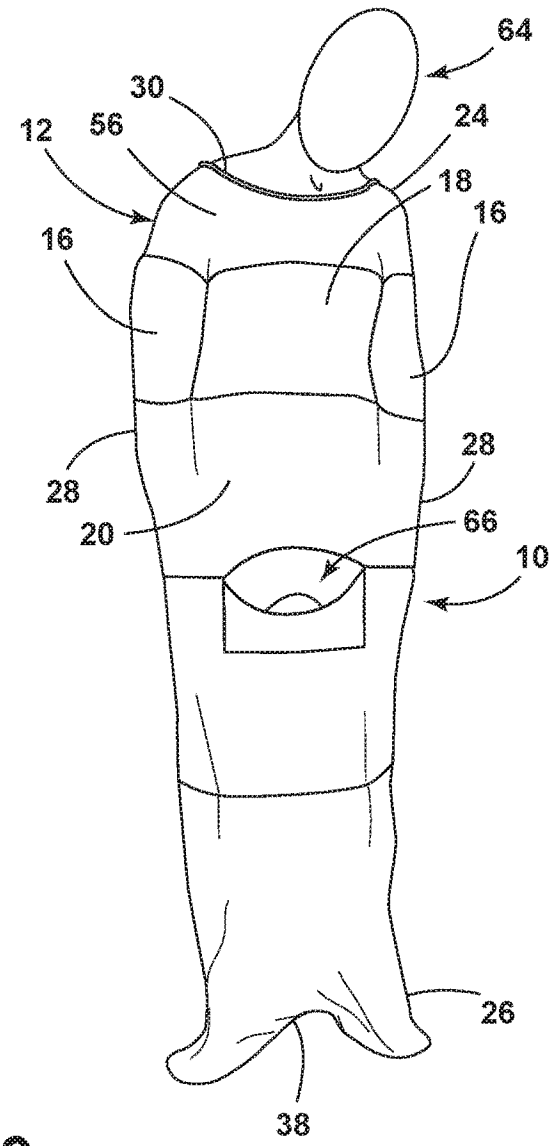
FIG. 9 is a representative view of an adult wearing a swaddling garment according to a fifth embodiment of the invention.

FIG. 9 depicts an example of an adult 694 wearing a swaddling garment 10 according to a fifth embodiment of the invention. The swaddling garment 10 can be substantially similar to the swaddling garments 10 described previously, and like elements are referred to by the same reference numerals. The swaddling garment 10 of FIG. 9 differs by being sized for an adult wearer, rather than an infant, and can be configured to provide deep pressure therapy. The swaddling garment 10 covers the torso, arms, and legs of the adult 64, with the adult's head, neck, and upper shoulders exposed. The arm sleeves 16 can be configured to receive substantially the entire arm of the wearer, or as shown can receive the upper arm of the wear. In other embodiments, the adult swaddling garment 10 for deep pressure therapy can cover the torso and arms, and not the legs. In one example, the swaddling garment 10 of FIG. 9 can be configured to apply a compression of 10-40 mmHg to at least the torso and/or arms of the wearer.

The foot end 24 or lower portion 34 of the adult swaddling garment 10 can be closed, open, or comprise an envelope fold as described above. In the illustrated embodiment, the foot end 24 includes closed bottom 38. Optionally, an access opening 66, such as but not limited to an envelope fold, can be provided on the garment 10 for convenient urination without completely removing the garment 10.

In yet another embodiment, the swaddling garment 10 disclosed herein can alternatively be configured for wear by a pet or other animal. The swaddling garment 10 can be provided in varying sizes depending on the age size and type of animal. Generally speaking, the swaddling garment 10 covers at least a portion of the front legs and torso of the animal, with the arm sleeves 16 receiving the front legs of the animal and the torso-receiving space 18 receiving the torso of the animal.

Directional terms, such as "vertical," "horizontal," "top," "bottom," "upper," "lower," "inner," "inwardly," "outer" and "outwardly," are used herein to assist in describing the invention based on the orientation of the embodiments shown in the illustrations. The use of directional terms should not be interpreted to limit the invention to any specific orientation(s).

The above description is that of current embodiments of the invention. Various alterations and changes can be made without departing from the spirit and broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual element(s) of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular.

The invention claimed is:

1. A swaddling garment comprising:

a tubular body defining an interior volume and having a circular neck opening into the interior volume;

a first arm sleeve forming the tubular body, the first arm sleeve having a first arm entry opening and defining a first arm-receiving space;

a second arm sleeve forming the tubular body, the second arm sleeve having a second arm entry opening and defining a second arm-receiving space; and a torso-receiving tube forming the tubular body and positioned between the first and second arm sleeves, the torso-receiving tube defining a torso-receiving space;

wherein the first and second arm sleeves extend alongside the torso-receiving tube to keep a wearer's arms and hands down alongside a wearer's torso;

wherein the first arm sleeve, the second arm sleeve, and the torso-receiving tube comprise three continuously formed tubes, each of the three continuously formed tubes comprising a single layer of textile material; and wherein the swaddling garment consists of a one-piece, seamless, knit garment.

2. The swaddling garment of claim 1, wherein the torso-receiving tube is configured to apply a higher level of compression than the first and second arm sleeves.

3. The swaddling garment of claim 1, wherein the one-piece, seamless, knit garment comprises a 3D knit garment.

4. The swaddling garment of claim 1, wherein the circular neck opening comprises a continuous, uninterrupted edge.

5. The swaddling garment of claim 1, wherein the first arm sleeve comprises a first hand opening opposite the first arm entry opening, and the second arm sleeve comprises a second hand opening opposite the second arm entry opening.

6. The swaddling garment of claim 1, wherein the first and second arm entry openings are spaced below the neck opening.

7. The swaddling garment of claim 1, wherein the tubular body comprises an upper portion and a lower portion, the upper portion comprising the first and second arm sleeves and the torso-receiving space, and wherein the lower portion has a larger diameter than the torso-receiving space.

8. The swaddling garment of claim 1, wherein the first and second arm sleeves are formed within the tubular body by knitting stitches connecting a front side of the tubular body to a rear side of the tubular body.

9. The swaddling garment of claim 1, wherein the tubular body is symmetrical about a longitudinal axis, with the first and second arm sleeves are disposed laterally on opposite sides of the longitudinal axis.

10. The swaddling garment of claim 1, wherein the tubular body comprises a lower portion defining a leg-receiving space, the lower portion comprising an access opening and an envelope fold formed by overlapping inner and outer flaps.

11. The swaddling garment of claim 1, wherein the tubular body is one of:

sack-shaped, and comprises a closed bottom opposite the neck opening; and tube-shaped, and comprises a bottom opening opposite the neck opening.

12. The swaddling garment of claim 1, wherein the tubular body comprises a head end including the neck opening and a foot end opposite the head end, and the tubular body tapers toward each of the head end and the foot end.

13. The swaddling garment of claim 1, wherein the tubular body comprises a shoulder band at an upper edge of the first and second arm sleeves and the torso-receiving space, the shoulder band extending around the circumference of the tubular body and including the circular neck opening.

14. The swaddling garment of claim 1, wherein the arm sleeves are disposed on laterally opposing sides of the torso-receiving tube, and extend longitudinally alongside the torso-receiving tube.

* * * * *